US006447319B1

(12) United States Patent
Bodin

(10) Patent No.: US 6,447,319 B1
(45) Date of Patent: Sep. 10, 2002

(54) HERMAPHRODITE ELECTRICAL CONNECTION DEVICE

(75) Inventor: Jacques Bodin, Basse Goulaine (FR)

(73) Assignee: Sercel (FR)

( * ) Notice: Subject to any disclaimer, the term of this patent is extended or adjusted under 35 U.S.C. 154(b) by 0 days.

(21) Appl. No.: 09/762,383

(22) PCT Filed: Aug. 4, 1999

(86) PCT No.: PCT/FR99/01930

§ 371 (c)(1),
(2), (4) Date: Apr. 12, 2001

(87) PCT Pub. No.: WO00/08724

PCT Pub. Date: Feb. 17, 2000

(30) Foreign Application Priority Data

Aug. 6, 1998 (FR) ..... 98 10125

(51) Int. Cl.[7] ..... H01R 4/54
(52) U.S. Cl. ..... 439/314; 439/294
(58) Field of Search ..... 439/284, 266, 439/314, 316; 284/369; 286/319, 294, 284, 286, 314

(56) References Cited

U.S. PATENT DOCUMENTS 3,252,124 A * 5/1966 Hansen ..... 339/47
3,271,726 A * 9/1966 Pfendler ..... 339/49
3,855,566 A * 12/1974 Richardson ..... 339/49
4,037,902 A * 7/1977 Miller ..... 339/49
4,595,251 A * 6/1986 Moulin ..... 339/47
4,820,185 A * 4/1989 Moulin ..... 439/321
5,658,159 A * 8/1997 Gardner et al. ..... 439/234
6,165,013 A * 12/2000 Broussard ..... 439/606

* cited by examiner

*Primary Examiner*—P. Austin Bradley
*Assistant Examiner*—Alexander Gilman
(74) *Attorney, Agent, or Firm*—Blakely Sokoloff Taylor & Zafman

(57) ABSTRACT

The invention concerns an electrical connection device in particular for constituting geophysical data acquisition and processing systems, consisting of two identical electrically and mechanically fitting male/female connectors, each connector comprising a body (10) bearing a set of connection pins and a ring (20) enclosing the connector body base and capable of being moved in rotation relatively to said body, the connector ring comprising an raised motif (27) for plugging in the associated connector. The invention is characterized in that the body of each connector comprises two stages of raised motif of which one front raised stage substantially matching the ring motif to co-operate with the associated connector ring motif in a locked position of the device and a rear stage to co-operate with the ring motif of the same connector in a retracted position of said ring.

16 Claims, 4 Drawing Sheets

HERMAPHRODITE ELECTRICAL CONNECTION DEVICE

The present invention relates to connection devices for interconnecting cables for conveying energy and signals and/or devices for acquiring, sending, processing, or storing signals.

The invention relates more particularly to connectors used in the art of geophysics to make up systems for acquiring and processing data on site.

During geophysical data acquisition surveys, operators use networks made up of sensors such as geophones or hydrophones connected by cables to intermediate devices each of which concentrates the signals from the sensors connected to it. The intermediate devices are themselves connected by cables to a central processor unit (CPU) to which they transmit the concentrated signals.

Networks of the above kind, which can be referred to as "comb arrays", are used in a terrestrial or an offshore environment and necessitate major and costly logistical resources (for deploying the arrays, towing them in an offshore environment, etc.).

To maximize the area covered by an array and thereby increase cost effectiveness by minimizing the time for which the logistical resources are monopolized, operators can deploy very large arrays employing from 500 to 2000 devices connected in pairs by cables of the order of 50 meters long.

However, although increasing the size of the arrays is beneficial from the point of view of increasing cost effectiveness, it has several drawbacks:

- firstly, the fact that the arrays use different connectors, depending on the connection to be made (cable, device, cable-sensor, cable-cable, cable-CPU, etc.) requires a large number of spare connectors to be available on site so that faulty components can be replaced in real time; and
- secondly, the complexity of the array increases the risk of wrong connections (in particular by inverting the direction of deployment of a line of sensors which, with the usual male and female connectors, necessitates physical redeployment of the line, constituting a penalty in terms of down-time and consequently of cost-effectiveness.)

It is therefore apparent that there is a requirement to standardize connecting devices in order to reduce the number of different connector designs employed and thereby simplify the deployment and use of geophysics acquisition arrays.

Moreover, existing connectors generally include threaded mechanical connection means. This makes joining and separating the connectors relatively complex and in a severe environment exposes the connection to the risk of binding.

A hermaphrodite connector is also known from U.S. Pat. No. 3,855,566. However, such a connector provides only a partial solution to the above-mentioned problems, in particular because it enables two connector elements to be locked only over small angular ranges θ1 on the circumference of the connector. As a result the mechanical strength of the connection between the connectors is limited.

The object of the invention is to provide a connection device using two symmetrical and hermaphrodite connectors which are particularly simple to manipulate.

To achieve the above object, a first aspect of the invention proposes an electrical connection device, in particular for making up systems for acquiring and processing geophysical data, the connection device consisting of the combination of two identical connectors which are electrically and mechanically hermaphrodite, each connector including a body carrying a set of contacts and a ring surrounding the base of the body of the connector, adapted to be rotated relative to said body and including a raised pattern, the device being characterized in that the body of each connector includes two raised pattern sections of which a front section is essentially complementary to the pattern on the ring of the associated connector to co-operate with the pattern on the ring in a locked configuration of the device and a rear section to co-operate with the pattern on the ring of the same connector in a retracted position of said ring.

Preferred, but non-limiting, features of the device according to the invention are as follows:

- the pattern of the rear section on the body of each connector is essentially complementary to the pattern on the ring,
- the patterns of the front section on the body of each connector are distributed over a plurality of members projecting out of the body and separated by spaces regularly distributed around the circumference of the body,
- there are two projecting members and they are diametrally opposed on the circumference of the body,
- said spaces are adapted to receive the projecting members of the associated connector,
- the pattern on the ring is integral with it,
- the patterns on the connector body are integral with it,
- the pattern on the ring consists of two projecting parts of the periphery of the ring each having the general shape of a sector of an annular rib and in that the two sections of the pattern on the body each have the general shape of a sector of a groove,
- each connector includes housings each adapted to receive a male contact and housings each adapted to receive a female contact,
- includes the same number of housings each adapted to receive a male contact and of housings each adapted to receive a female contact and said housings each adapted to receive a male contact and said housings each adapted to receive a female contact are alternately distributed to form the corners of a regular polygon on one face of the connector,
- each connector includes two housings each adapted to receive a male contact and two housings each adapted to receive a female contact,
- it includes means for guaranteeing a sealed connection when the device is locked,
- said sealing means include a layer of elastomer material,
- the pattern of the front section on the body of each connector includes ramps that are inclined towards the rear of the body along a generally radial slope line from the outside towards the inside of the body and the essentially complementary pattern on the ring of the associated connector includes complementary ramps so as to cause radially inward movement towards each other of the ring of one connector and the body of the associated connector when longitudinal traction is applied to the device along its axis which tends to separate the two connectors from each other,
- the essentially complementary patterns on the ring of each connector and of the front section on the body of the associated connector include a helicoidal pattern so that, on rotation of the ring of the connector to engage said ring with the body of the associated connector in the locked configuration of the device, said ring and said body of the associated connector co-operate in an essentially helicoidal movement terminating in axial clamping of said ring and said body of the associated connector, the helicoidal pattern on the ring of each connector is respectively delimited at the front and at the rear by two raised rims with different pitches that respectively correspond to the pitches of the rear and front edges of the helicoidal pattern on the body of the associated connector.

A second aspect of the invention proposes an electrical connector, in particular for making up systems for acquiring and processing geophysical data, adapted to be carried by a device and to co-operate with one of the connectors of a device as defined above.

Preferred, but non-limiting, features of the connector according to the invention are as follows:

it includes a plurality of projecting members carrying a raised pattern essentially complementary to the front section of the pattern on the connector with which it co-operates, it includes a ring carrying a raised pattern adapted to co-operate with the pattern of the front section on the body of the connector with which it co-operates.

Finally, a third aspect of the invention proposes a protective cap for attachment to a connector of a device or a connector as defined above.

Preferred, but non-limiting, features of the cap according to the invention are as follows:

it includes a plurality of projecting members carrying a raised pattern essentially complementary to the front pattern section on the connector with which it co-operates, it includes a raised pattern adapted to co-operate with the pattern on the connector with which it co-operates, it includes a ring carrying a raised pattern adapted to co-operate with the pattern of the front section on the body of the connector with which the cap is adapted to co-operate or with the pattern on the connector with which the cap is adapted to co-operate.

Other aspects, objects and advantages of the invention will become more clearly apparent on reading the following description of one preferred embodiment of the invention, which description is given by way of example only and with reference to the accompanying drawings, in which.

Figure 1:
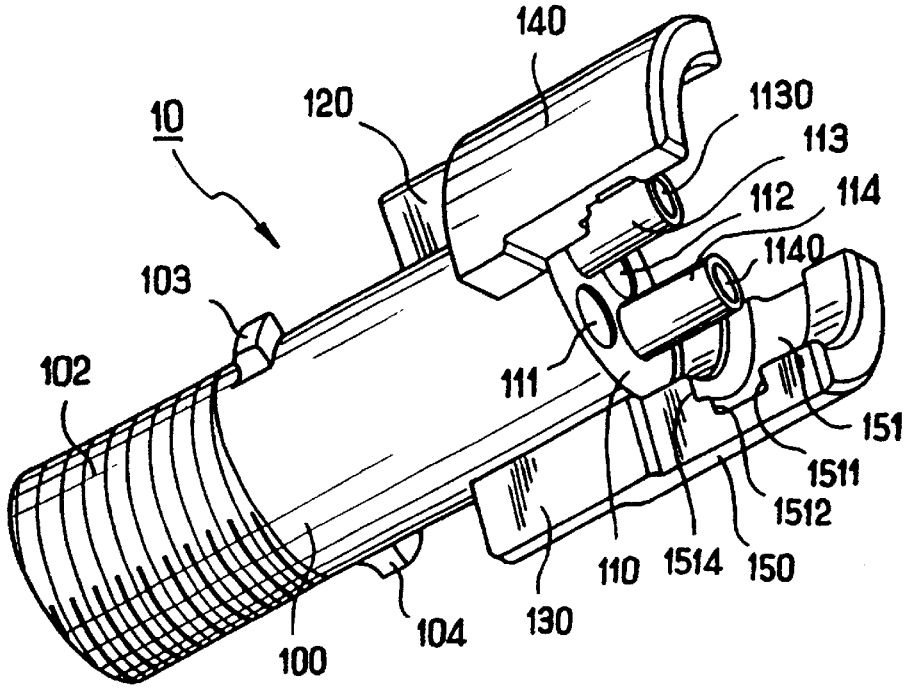
FIG. 1 is a perspective view of a connector body of the invention.
Figure 2:
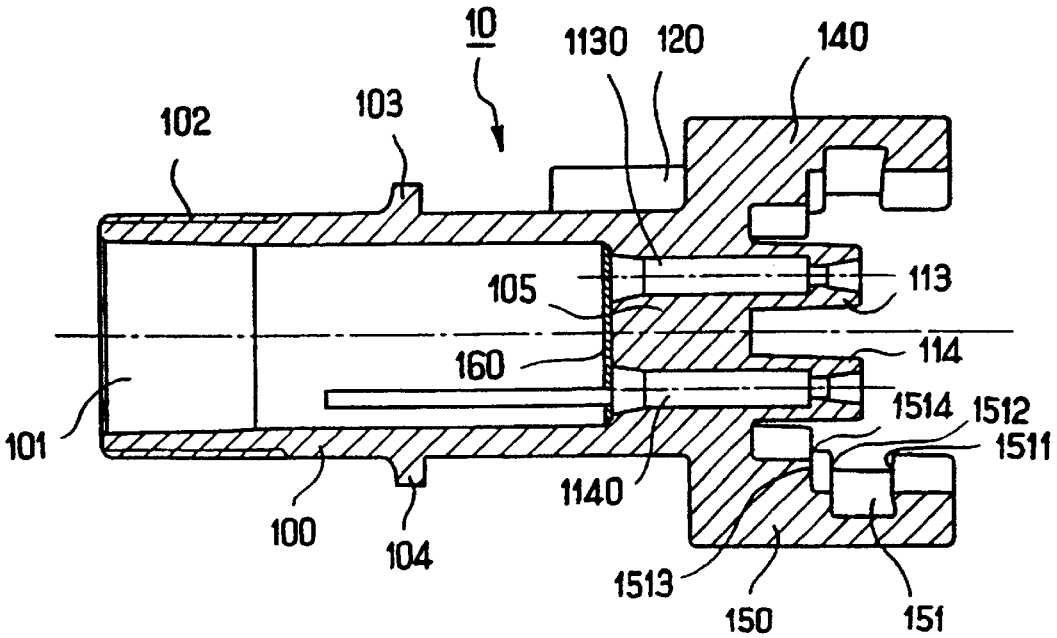
FIG. 2 is a sectional view of the body shown in FIG. 1.

The structure of the body of one embodiment of a connector in accordance with the invention is described first with reference to FIGS. 1 and 2.

The body 10 has an essentially cylindrical part 100 including a longitudinal bore 101 whose end is defined by a transverse wall 105 of the body. The cylindrical part 100 has a screwthread 102 around one end, referred to herein by convention as its "rear" end. Two radially projecting lugs 103 and 104 on the outside surface of and integral with the body 10 are diametrally opposed across the cross-section of the body.

The front face 110 of the wall 105 incorporates two cavities 111 and 112 which open into the bore 101 through the wall 105, in the direction towards the rear of the body. The face 110 also carries two integral and forwardly projecting chimneys 113 and 114 with respective bores 1130 and 1140 which also pass through the wall 105 and also open into the bore 101 in the direction towards the rear of the body.

The cavities 111 and 112 are essentially cylindrical and extend along an axis generally parallel to the longitudinal axis of the body 10. The two cavities are symmetrically disposed on respective opposite sides of a median longitudinal axis of the body.

Similarly, the chimneys 113 and 114 and their bores 1130 and 1140 are substantially parallel to the longitudinal axis of the body 10 and the chimneys 113 and 114 are symmetrically disposed relative to the median longitudinal axis of the body.

Moreover, the line joining the centers of the two chimneys is substantially perpendicular to the line joining the centers of the two cavities 111 and 112 and the distance between the centers of the chimneys is equal to the distance between the centers of the cavities 111 and 112. The two cavities 111 and 112 and the two projecting chimneys 113 and 114 therefore define the four corners of a square on the front face 110 of the wall 105.

The set of cavities and bores described hereinabove enables a contact assembly (not shown in FIGS. 1 and 2) to be inserted into the bore 101 from the rear, with two identical male contacts accommodated in the cavities 111 and 112 and two identical female contacts accommodated in the bores 1130 and 1140. Each male contact is adapted to co-operate with a female contact identical to the contacts in the bores 1130 and 1140. Each female contact is adapted to co-operate with a male contact identical to the contacts in the cavities 111 and 112.

Still referring to FIGS. 1 and 2, the front part of the body 10 carries two identical plane parts 120 and 130 which project radially outwards and are extended in the axial direction towards the front by respective identical projecting members 140 and 150 of generally cylindrical sector shape.

The two parts 120 and 130 (the function of which is explained later) are diametrally opposed on the circumference of the body 10, as are the two members 140 and 150. Each of the members 140 and 150 extends around the circumference of the body 10 in an angular sector subtending an angle slightly less than 90°.

The member 150 identical to the member 140 is now specifically described. The member 150 has on its inside face a groove 151 delimited at the front and at the rear by respective faces 1511 and 1512. FIG. 2, which is a sectional view of the groove 151, shows clearly that the front face 1511 is inclined towards the rear relative to the transverse direction, approaching the opening contour that coincides with the inside face of the member 150.

In the FIGS. 1 and 2 embodiment, a second face 1513 to the rear of the groove 151 defines a shoulder 1514. The face 1513 and the shoulder 1514 are consequences of the method of manufacturing the embodiment shown and have no function.

The faces 1511 and 1512 delimiting the groove 151 are not precisely perpendicular to the longitudinal axis of the body 10. They define two helicoidal ramps, both oriented in the forward direction, with respective pitches of 4 mm and 3 mm. Thus the groove 151 is itself delimited by two convergent walls, just like the groove in the part 140. The function of this particular feature of the invention is described in more detail later.

It has already been stated that the body 10 is adapted to receive a contact assembly whose four contacts engage in the cavities 111 and 112 and in the bores 1130 and 1140. A layer 160 of elastomer material is applied to the wall 105 to guarantee that the connection, which is described later, is sealed.

In this embodiment, the body 10 described above is molded from a plastics material to constitute a single one-piece component to which the elastomer material layer 160 is added.

The ring 20 adapted to co-operate with the body 10 of the connector according to the invention will now be described with reference to FIGS. 3 and 4. The ring has a peripheral part 21 including an essentially plane transverse face 23 that by convention is referred to as its "front" face. The part 21, whose thickness varies, has throughout its length a cavity 22 made up of four coaxial bores 221, 222, 223 and 224 which are juxtaposed axially and whose diameters decrease in the direction towards the front.

Figure 4:
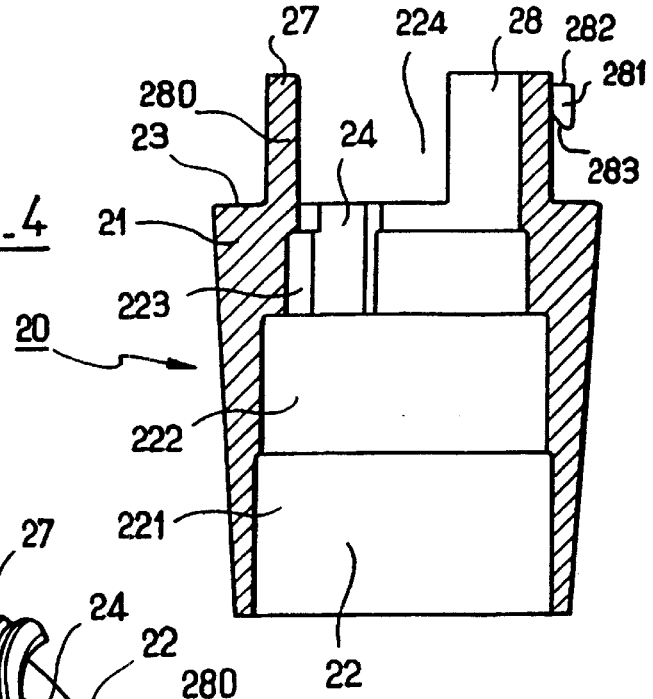
FIG. 4 is a sectional view of the ring shown in FIG. 3.

As shown in FIG. 4 in particular, the diameter of the cavity 22 has a minimum value at the front which is at least slightly greater than the diameter of the cylindrical part 100 of the body 10. The ring 20 can therefore be mounted on the part 1000 of the body 10 described with reference to FIGS. 1 and 2, on which it can then slide.

Two identical and diametrally opposed longitudinal grooves 24 and 25 are provided on the inside walls of the bores 223 and 224 at the front of the ring. The section of the grooves is chosen to receive the identical lugs 103 and 104, which slide in the grooves to guide the ring 20 when it is mounted on the body 10.

As indicated in FIG. 4, the grooves extend the entire length of the bores 223 and 224. Moreover, the diameter of the bore 22 immediately to the rear of the bore 223 is equal to the diameter of said bore 223 plus twice the depth H of each groove. The grooves 24 and 25 therefore discharge into the bore 223 in the direction towards the rear and flush with its inside wall and the ring can slide longitudinally on the body 10 provided with the lugs 103 and 104.

Two identical members 27 and 28 in the general form of cylindrical sectors extend towards the front from the face 23 of the ring. In this embodiment, the angular sectors subtended by these two members are substantially equal to those subtended by the projecting members 140 and 150 of the body 10, i.e. they subtend an angle of slightly less than 90°.

Figure 3:
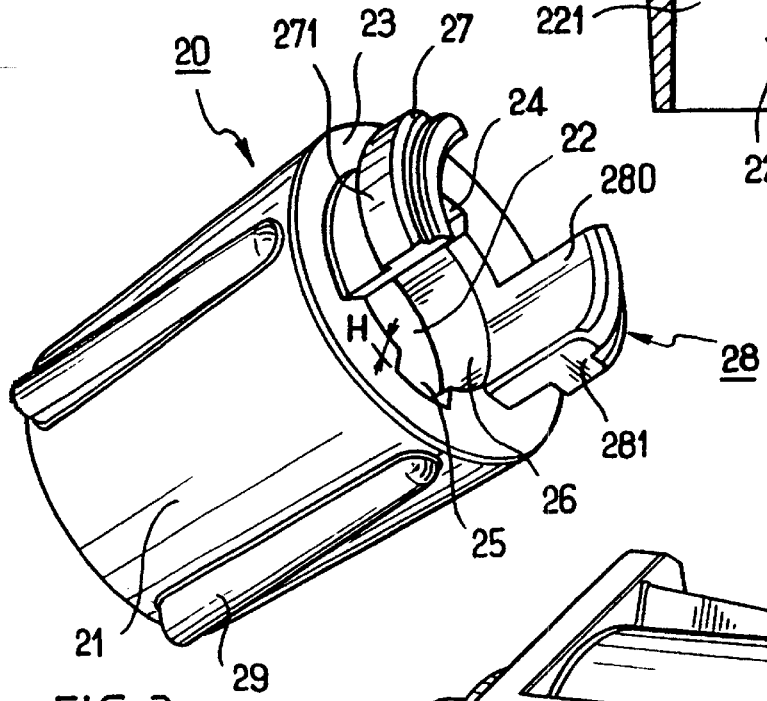
FIG. 3 is a perspective view of a ring of a connector of the invention.

Still referring to FIGS. 3 and 4, the member 28 identical to the member 27 includes a longitudinal and cylindrical sector 280 with a ring portion 281 projecting radially outwards on its outside periphery.

As indicated in FIG. 4, which is a sectional view of the member 28, the contour of the longitudinal section of the members 27 and 28 is complementary to the contour of the groove on the inside face of the members 140 and 150.

Accordingly, as shown later, the projecting ring parts 271 and 281 of the members 27 and 28 of a first connector are adapted to co-operate with the grooves of the members 140 and 150 carried by the body of an aligned second connector with its front face against the front face of the first connector.

In particular, the faces 282 and 283 respectively to the rear and to the front of the projecting ring member 281 define two helicoidal ramps with respective pitches of 4 mm and 3 mm and adapted to co-operate with the respective faces 1511 and 1512 (see FIG. 2).

To complete the description of the ring 20, longitudinal projecting parts 29 integral with the periphery of the ring facilitate grasping and manipulating the ring when it is rotated by an operator. In a different embodiment of the invention, not shown in the figures, the projecting parts 29 are replaced by recessed parts with the same function of facilitating grasping and manipulating the ring.

Figure 5:
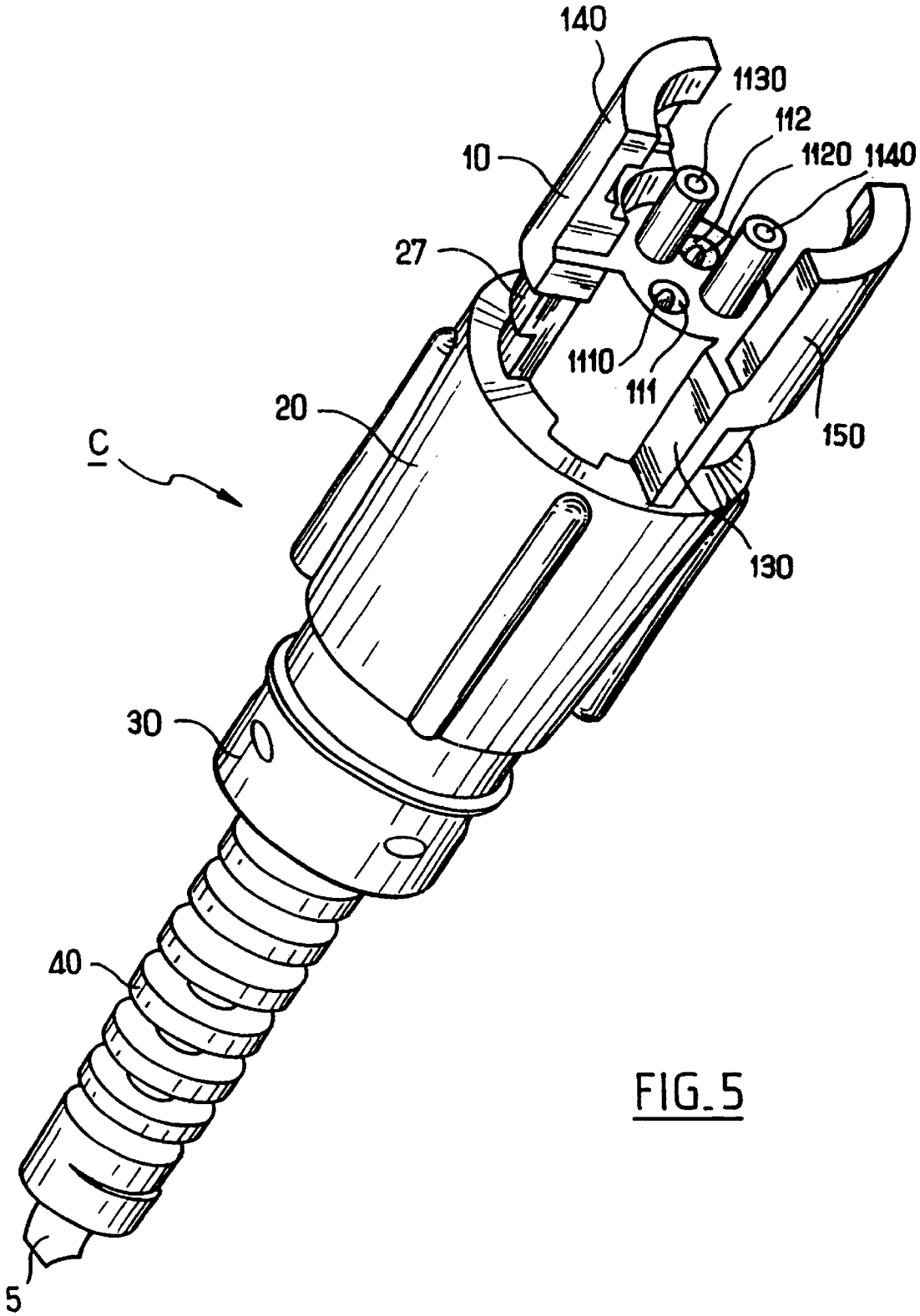
FIG. 5 is a perspective view of a connector of the invention including the body shown in FIGS. 1 and 2 and the ring shown in FIGS. 3 and 4.

FIG. 5 shows a connector obtained by mounting a ring 20 identical to that shown in FIGS. 3 and 4 on a body 10 identical to that shown in FIGS. 1 and 2.

A nut 30 is screwed onto the rear screwthread of the body 10 and constitutes an abutment for longitudinal rearward translatory movement of the ring. A generally helicoidal flexible member 40 is fastened to the nut 30 and surrounds and protects a cable 5 which contains four wires, two of which terminate at female contacts accommodated in the bores 1130 and 1140 (not shown in the figure) and the other two of which terminate at corresponding male contacts 1110 and 1120 accommodated in the respective cavities 111 and 112.

Still referring to FIG. 5, the ring 20 can be manipulated by rotating it about the body 10, its rotation being limited by contact between the members 27 and 28 and the parts 120 and 130. As already stated, the angle subtended by the members 27 and 28 is substantially equal to that subtended by the members 140 and 150, i.e. slightly less than 90° C. The rotation is therefore through slightly more than 90°.

The rotation of the ring defines two end of travel positions of the ring, namely a retracted position shown in FIG. 5, in which the members 27 and 28 of the ring are respectively aligned with the members 140 and 150 of the body, and a position that corresponds, as shown later, to locking of the connector and in which the members 27 and 28 are butted up against the parts 120 and 130 and are therefore offset approximately 90° relative to the members 140 and 150.

Translatory movement of the ring along the longitudinal axis of the connector is limited to a clearance defined at the rear by the nut 30 and at the front by the parts 140 and 150. This translatory clearance prevents rotation of the ring being impeded by excessive friction between the ring and the nut 30 or the parts 140 and 150.

How two connectors according to the invention are connected will now be described.

Starting from a situation in which two aligned connectors identical to that shown in FIG. 5 each have their ring in the retracted position, the front faces of the two connectors are moved towards each other in translation. The projecting members of one of the two connectors (the members 140 and 150 in FIG. 1) are engaged in the spaces between the like members of the other connector. Said members therefore interpenetrate in a complementary manner.

In conjunction with this interengagement of the projecting members, the chimneys of each connector (the chimneys 113 and 114 in FIG. 1) enter the cavities of the other connector (the cavities 111 and 112 in FIG. 1) and the male and female contacts of the two connectors connect the four wires of the cable of each connector in pairs.

Once this translatory interengagement has been completed, the device is locked by turning at least one of the rings approximately 90° to engage the projecting part of the ring (the parts 271 and 281 in FIG. 3) in the grooves on the body of the other connector (the groove 151 in FIG. 1).

Co-operation of the helicoidal ramps on the projecting parts of the ring with those in the grooves of the body of the other connector converts this 90° rotation into helicoidal movement of the ring of one connector relative to the body of the other connector this tightens the mechanical connection, which is then "screwed tight".

Moreover, as stated already, the grooves and the projecting parts have non-parallel edges so that there is always a clearance between at least one edge of one groove and the adjacent edge of a projecting part engaged in the groove. In the situation in which the connector is exposed to cold and moisture (which routinely arises in the use of geophysics arrays), this clearance enables deposits of ice formed in the groove to be removed on engaging the projecting part in the groove.

The particular geometry of the inclined front face 1511 of the groove 151 shown in FIG. 1 and that of the projecting parts 271 and 281 shown in FIG. 3 ensure that once the device is locked the projecting parts of the ring co-operate with the grooves in which they are engaged to improve further the quality of the connection between the two connectors.

If longitudinal traction tending to separate the two connectors is applied when they are locked together, the inclination of the front faces of the grooves in the members 140 and 150 and the like projecting parts converts a portion of the force exerted longitudinally into an inwardly directed radial component applied to the parts 149 and 150. The effect of this particular feature is to strengthen further the connection between two connectors when locked together.

The device described hereinabove can be used underwater. The sealing layer 160 at the end of the central bore 101 of each connector body individually seals each contact, which the layer 160 isolates from the wire to which the contact is connected. It is therefore possible to connect and disconnect the device according to the invention underwater.

Also, the layer 160 totally isolates the cavity from the bore 101 at the front of the connector. When the device is connected, water contained in the cavities 111 and 112 of a connector is therefore expelled from the connector when the chimneys of the other connector are inserted.

One advantageous feature of the device described hereinabove is that it is sufficient to position only one ring of a pair of connectors in the locked position to fasten the connectors together. The second ring can be left in the retracted position (in the case of multiple temporary connections, for example). It is also possible to move both rings of like connectors to the locked position, making the connection even more secure.

The device described above constitutes a hermaphrodite connection, both mechanically and electrically, enabling two identical connectors to be connected. A natural use of such connectors is to connect two cables.

The invention can also be used to fit a device with a connector embedded in one face of the device and including the same mechanical attachment means and electrical connection means as the connector shown in FIG. 5.

Figure 6:
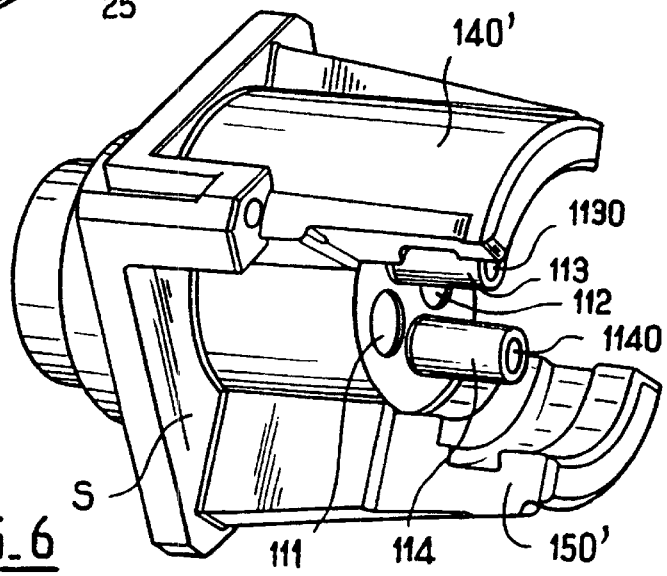
FIG. 6 is a perspective view of a first embodiment of a connector of the invention for connecting a device.

FIG. 6 shows a connector of this kind. It includes electrical contacts identical to those of the body shown in FIG. 1 in the cavities 111 and 112 and in the bores 1130 and 1140 of the chimneys 113 and 114. It also includes two projecting members 140' and 150' similar to the members 140 and 150 shown in FIG. 1.

The device connector does not include a ring because a single ring is sufficient to lock a connection, as already pointed out. The device connector can therefore be used with the connector shown in FIG. 5 to connect a cable to the device in which the connector is embedded with the surface S at the rear of the connector and directed towards the front flush with a face of the device. In an embodiment that is not shown in the figures, the device connector has a ring analogous to that shown in FIGS. 3 and 4.

Figure 7:
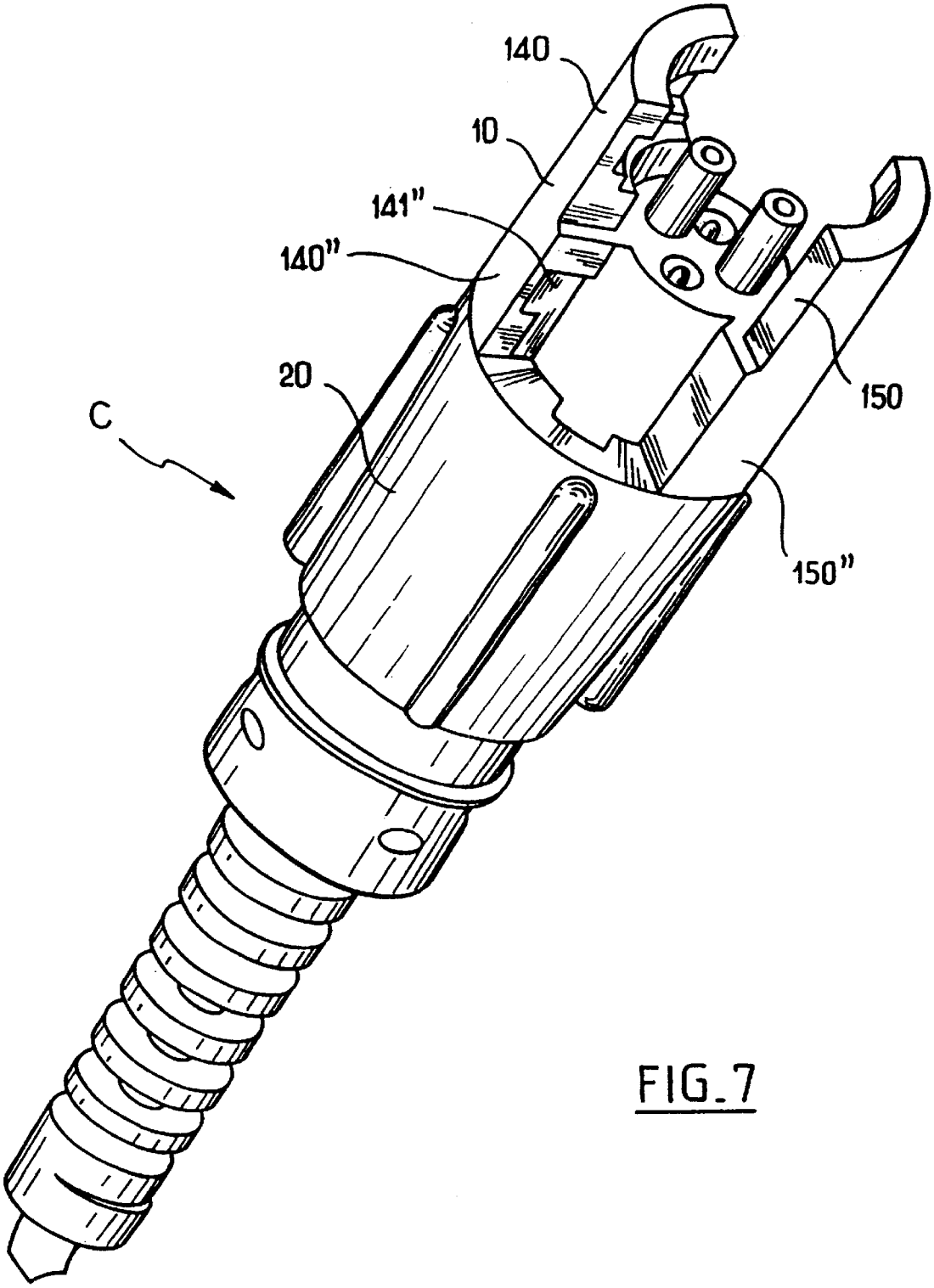
FIG. 7 is a diagrammatic perspective view of a second embodiment of a connector of the invention.

In an embodiment shown diagrammatically in FIG. 7, the forwardly projecting parts 140 and 150 of the connector are extended longitudinally by respective flanges 140" and 150" extending towards the rear as far as the ring 20 mounted on the body 10.

In this embodiment, the flanges 140" and 150" include grooves 141" to receive the projecting ribs 271 and 281 on the ring in the retracted position. This is advantageous functionally because it protects the upstanding ribs of the retracted ring and aesthetically because it offers a continuity that is beneficial from the styling point of view.

Finally, the invention provides a cap, not shown in the figures, having a solid rear face, a body including two projecting parts similar to the parts 140 and 150 shown in FIGS. 1 and 2 (and possibly a ring similar to that shown FIGS. 3 and 4) adapted to be attached to and protect any of the connectors described above.

What is claimed is:

1. An electrical connection device, in particular for making up systems for acquiring and processing geophysical data, the connection device including a combination of two identical connectors which are electrically and mechanically hermaphrodite, each connector (C) including a body (10) carrying a set of contacts (1110, 1120) and a ring (20) surrounding the base of the body of the connector, adapted to be rotated relative to said body and including a raised pattern (271, 281), the device characterized in that the body of each connector includes two raised pattern sections of which a front section (151) is essentially complementary to the pattern on the ring of the associated connector to co-operate with the pattern on the ring in a locked configuration of the device and a rear section (120, 130) to co-operate with the pattern on the ring of the same connector in a retracted position of said ring.

2. A device according to claim 1, characterized in that said spaces are adapted to receive the projecting members (140, 150) of the associated connector.

3. A device according to claim 1, characterized in that the pattern (271, 281) on the ring is integral with it.

4. A device according to claim 1, characterized in that the patterns on the connector body are integral with it.

5. A device according to claim 1, characterized in that the pattern on the ring consists of two projecting parts (271, 281) of the periphery of the ring each having the general shape of a sector of an annular rib and in that the two sections of the pattern on the body each have the general shape of a sector of a groove.

6. A device according to claim 1, characterized in that each connector includes housings (111, 112) each adapted to receive a male contact (1110, 1120) and housings (1130, 1140) each adapted co receive a female contact.

7. A device according to claim 6, characterized in that it includes the same number of housings each adapted to receive a male contact and of housings each adapted to receive a female contact and said housings each adapted to receive a male contact and said housings each adapted to receive a female contact are alternately distributed to form the corners of a regular polygon on one face of the connector.

8. A device according to claim 7, characterized in that each connector includes two housings each adapted to receive a male contact and two housings each adapted to receive a female contact.

9. A device according to claim 1, characterized in that the pattern of the front section (151) on the body of each connector includes ramps (1511) that are inclined towards the rear of the body along a generally radial slope line from the outside towards the inside of the body and in that the essentially complementary pattern (271, 281) on the ring of the associated connector includes complementary ramps (283) so as to cause radially inward movement towards each other of the ring of one connector and the body of the associated connector when longitudinal traction is applied to the device along its axis which tends to separate the two connectors from each other.

10. A device according to claim 1, characterized in that said device includes means (160) for providing a sealed connection when the device is locked.

11. A device according to claim 12, characterized in that said sealing means include a layer of elastomer a material.

12. A device according to claim 1, characterized in that the essentially complementary patterns on the ring of each connector and of the front section on the body of the associated connector include a helicoidal pattern so that, on rotation of the ring of the connector to engage said ring with the body of the associated connector in the locked configuration of the device, said ring and said body of the associated connector co-operate in an essentially helicoidal movement terminating in axial clamping of said ring and said body of the associated connector.

13. A device according to claim 12, characterized in that the helicoidal pattern on the ring of each connector is respectively delimited at the front and at the drear by two raised rims (282, 283) with different pitches that respectively correspond to the pitches of the rear and front edges (1512, 1511) of the helicoidal pattern on the body of the associated connector.

14. A device according to claim 1, characterized in that the pattern (141") of the rear section on the body of each connector is essentially complementary to the pattern (271, 281) on the ring (20).

15. A device according to claim 1 or claim 14, characterized in that the patterns (151) of the front section on the body of each connector are distributed over a plurality of members (140, 150) projecting out of the body and separated by spaces regularly distributed around the circumference of the body.

16. A device according to claim 15, characterized in that there are two projecting members (140, 150) and they are diametrally opposed on the circumference of the body.

* * * * *

UNITED STATES PATENT AND TRADEMARK OFFICE

CERTIFICATE OF CORRECTION

PATENT NO. : 6,447,319 B1 
DATED : September 10, 2002
INVENTOR(S) :Bodin

It is certified that error appears in the above-identified patent and that said Letters Patent is hereby corrected as shown below:

Title page,
Item [57], ABSTRACT, please delete "The invention concerns...position of said ring." and insert -- An electrical connection device for constituting geophysical data acquisition and processing systems. The device includes two identical electrically and mechanically fitting male/female connectors. Each connector has a body bearing a set of connection pins and a ring enclosing the connector body base and capable of being moved in rotation relatively to the body. The connector ring has a raised motif for plugging in the associated connector. The body of each connecor has two stages of raised motifs of which one front raised stage substantially matches the ring motif to co-operate with the associated connector ring motif in a locked position of the device and a rear stage to co-operate with the ring motif of the same connector in a retracted position of the ring. --

Signed and Sealed this

Fourteenth Day of September, 2004

JON W. DUDAS
*Director of the United States Patent and Trademark Office*